US009162157B2

(12) United States Patent
Scarborough

(10) Patent No.: US 9,162,157 B2
(45) Date of Patent: Oct. 20, 2015

(54) MAGNETIC HOOP APPARATUS

(71) Applicant: Laura Marie Scarborough, Austin, TX (US)

(72) Inventor: Laura Marie Scarborough, Austin, TX (US)

( * ) Notice: Subject to any disclaimer, the term of this patent is extended or adjusted under 35 U.S.C. 154(b) by 32 days.

(21) Appl. No.: 14/222,117

(22) Filed: Mar. 21, 2014

(65) Prior Publication Data

US 2015/0265941 A1 Sep. 24, 2015

(51) Int. Cl.
*A63J 5/02* (2006.01)
*A63J 7/00* (2006.01)

(52) U.S. Cl.
CPC ..... *A63J 7/00* (2013.01)

(58) Field of Classification Search
CPC ..... A63J 5/02
USPC ..... 472/68
See application file for complete search history.

(56) References Cited

U.S. PATENT DOCUMENTS 5,102,076 A * 4/1992 North et al. ..... 248/95
2013/0210554 A1* 8/2013 Carlson ..... 473/417

* cited by examiner

*Primary Examiner* — Michael Dennis

(57) ABSTRACT

A magnetic hoop apparatus includes a hollow tube, at least one magnet, a coupling, at least one counterweight, an ornamental tape, and a protective tape. A first end and a second end of the hollow tube are either attached or connected to each other by the coupling creating a circular shape hoop. The at least one magnet and the at least one counterweight are positioned within the hoop, where radial movement of the magnet and the counterweight are restricted by at least one rivet. The ornamental tape is wrapped around the hoop, and the protective tape is wrapped around the ornamental tape adjacent to the at least one magnet. The magnets within multiple magnetic hoops attach with each other in order to create a system of hoop while the counterweights within the multiple magnetic hoops balance the system of hoop.

18 Claims, 11 Drawing Sheets

DETAIL B
SCALE 1 : 4

DETAIL A
SCALE 1 : 4

MAGNETIC HOOP APPARATUS

FIELD OF THE INVENTION

The present invention relates generally to an apparatus for magnetic hoops. More specifically, the present invention is a hollow hoop containing a magnet which can swivel and turn within the hoop tubing, allowing the user to combine a plurality of hoops in various ways during a performance, dance, or other forms of artistic expression.

BACKGROUND OF THE INVENTION

Hoops are often used as a prop in performances such as dance and magic tricks. The range of tricks and motions which can be performed with a regular plastic hoop is limited. Magnetic hoops have a wider range of performance ability than regular hoops but are still limited as the polarity of each magnetic hoop must be paired. It is therefore an object of the present invention to introduce a magnetic hoop which can attach together through magnetic attraction to create a "floating-like" illusion, where the magnets can swivel and turn inside the tubing to allow a number of ways in which hoops can be combined.

DETAIL DESCRIPTIONS OF THE INVENTION

Figure 1:
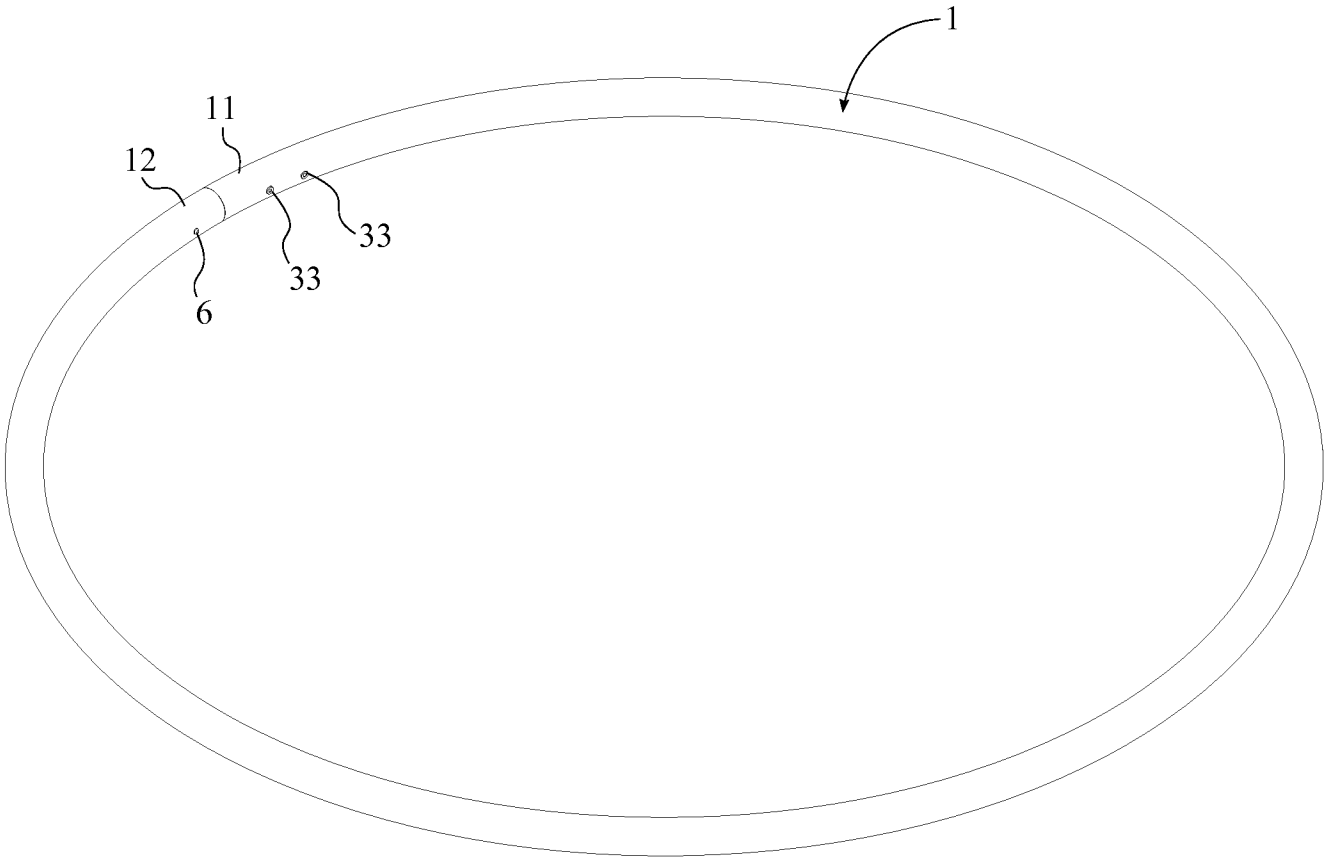
FIG. 1 is a perspective view of the present invention without the ornamental tape and the protective tape.

All illustrations of the drawings are for the purpose of describing selected versions of the present invention and are not intended to limit the scope of the present invention.

The present invention is a magnetic hoop apparatus which contains one or more sleeved magnets within the hoop. The sleeved magnets create point of attraction among two or more hoops. When the sleeved magnets contained within two or more hoops, and the two or more hoops are placed in close proximity to one another, the magnets cause the hoops to "stick" together so that when used for play, dance, or other artistic expression, the hoops provide a magical "floating-like" perception for the viewer. A unique characteristic of the present invention is that the sleeved magnets can turn and swivel within the hoop, thus allowing the hoops to link together in many different combinations.

In reference to FIG. 1-FIG. 7, the present invention comprises a hollow tube 1, at least one magnet 3, a coupling 4, at least one counterweight 7, an ornamental tape 8, and a protective tape 9. The hollow tube 1 comprises a first end 11, a second end 12, an outer annular wall 13, an inner annular wall 14, a first opening 15, and a second opening 16. The hollow tube 1 can be made from flexible plastic or any other type of materials similar to the flexible plastic. The first end 11 and the second end 12 for the hollow tube 1 are oppositely positioned from each other along the hollow tube 1, where the inner annular wall 14 of the hollow tube 1 is concentrically positioned within the outer annular wall 13 of the hollow tube 1 from the first end 11 to the second end 12. The first opening 15 of the hollow tube 1 is traversed into the first end 11, where the first opening 15 is encircled by the inner annular wall 14. Similarly the second opening 16 of the hollow tube 1 is traversed into the second end 12, where the second opening 16 is encircled by the inner annular wall 14.

Figure 4:
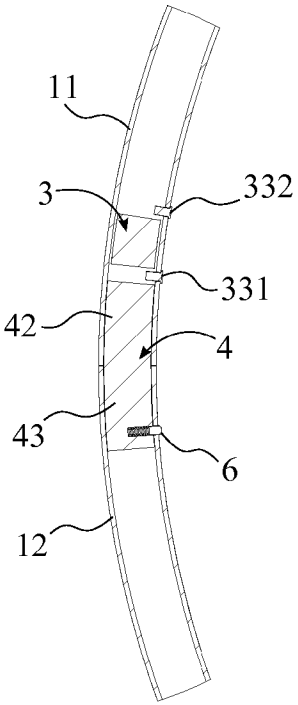
FIG. 4 is a detail section view illustrating the inside components of the present invention, showing the detail section-A of FIG. 3.
Figure 8:
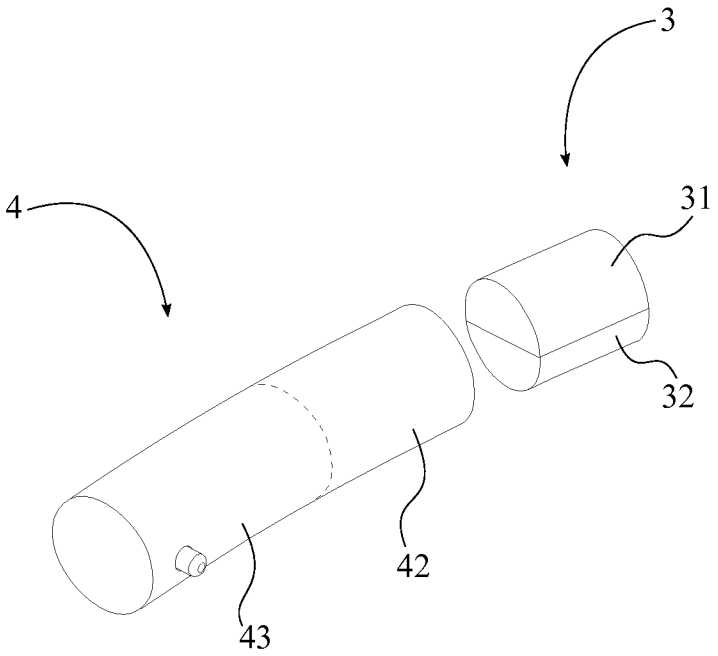
FIG. 8 is perspective view of the coupling and the at least one magnet of the present invention.

In reference to FIG. 4 and FIG. 8, the coupling 4 comprises a first base portion 42 and a second base portion 43. The first base portion 42 and the second base portion 43 are oppositely positioned from each other along the coupling 4. The diameter of the coupling 4 is slightly smaller than the diameter of the inner annular wall 14, where the coupling 4 functions as the attachment component in between the first end 11 and the second end 12 of the hollow tube 1.

Figure 2:
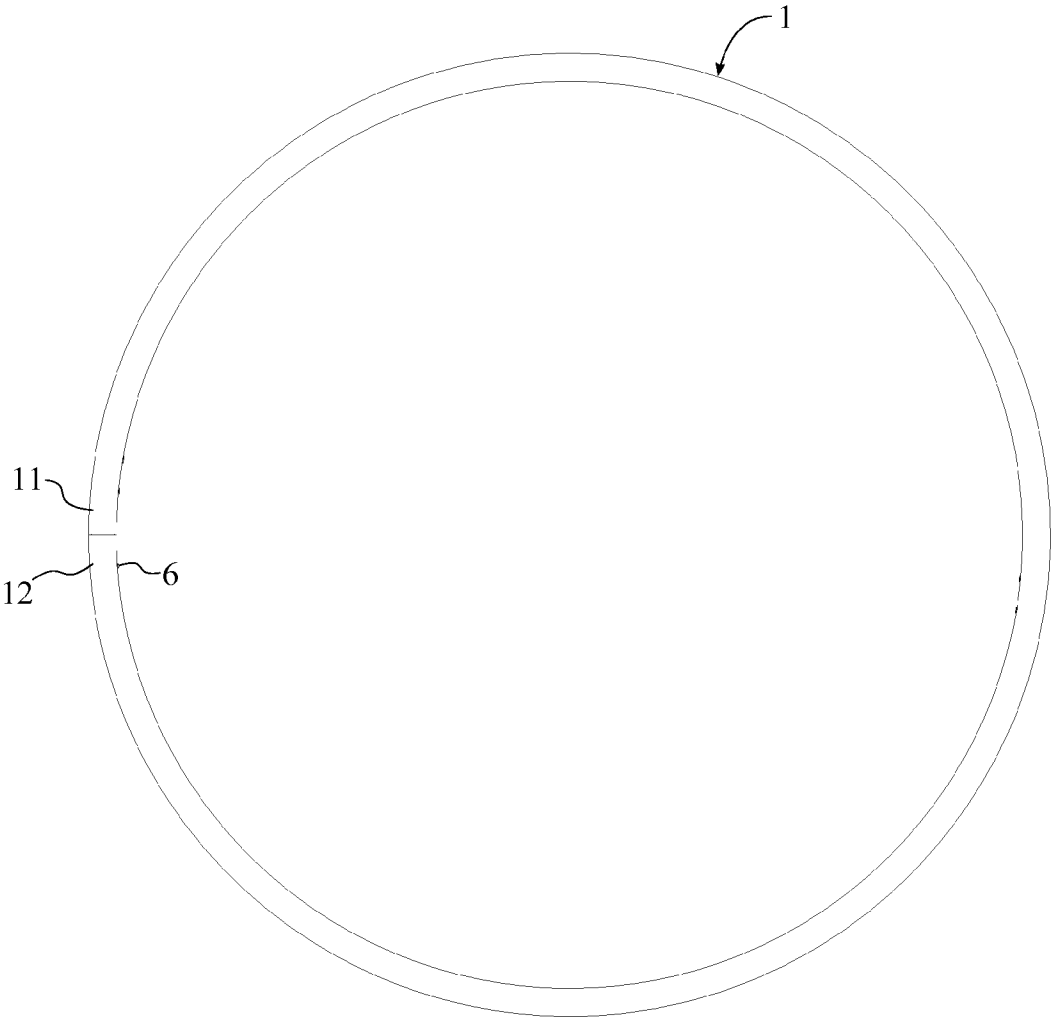
FIG. 2 is a top view of the present invention without the ornamental tape and the protective tape.
Figure 3:
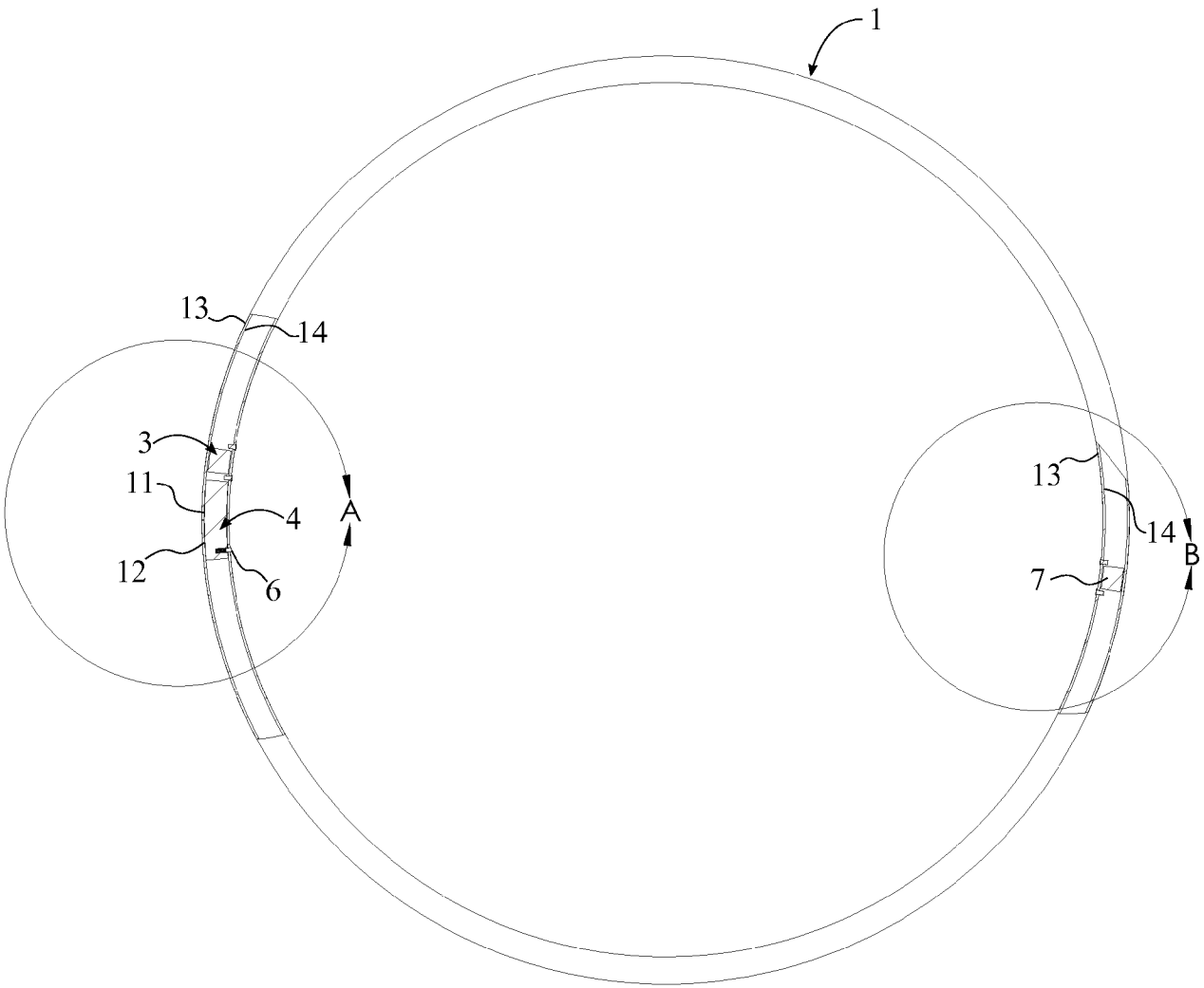
FIG. 3 is a top view of the present invention showing the inside components.

In reference to FIG. 1-FIG. 3, the first end 11 of the hollow tube 1 is adjacently positioned with the second end 12 of the hollow tube 1, where the coupling form the hollow tube 1 into a circular shape within the present invention so that a hoop can be constructed. More specifically, the first base portion 42 is inserted into the first opening 15 of the hollow tube 1 in such way that the first base portion 42 permanently connects with the first end 11 as the first base portion 42 concentrically positions within the inner annular wall 14. The second base portion 43 is inserted into the second opening 16 of the hollow tube 1 in such way that the second base portion 43 concentrically positions within the inner annular wall 14. The second base portion 43 of the present invention can be either removably attaches with the second end 12 by an attachment mechanism 6 or permanently connects with the second end 12. The coupling 4, the attachment mechanism 6 or the permanent connection, and the hollow tube 1 create the circular shape of the present invention forming the hoop. The first base portion 42 of the coupling 4 is completely traversed into the first opening 15 of the hollow tube 1, and second base portion 43 of the coupling is also completely traversed into the second opening 16 of the hollow tube 1, as the attachment mechanism 6 or the permanent connection secures the coupling 4 with the hollow tube 1. The preferred attachment mechanism 6 of the present invention is a spring loaded button locking mechanism, but the attachment mechanism 6 can include, but is not limited to, a friction locking mechanism, a snap fit locking mechanism, or any other type of similar locking mechanisms. The attachment mechanism 6 allows the present invention to be disassembled when the present invention is not used by the user so that the present invention requires minimum storage space and can be easily carried away.

In reference to FIG. 8, the at least one magnet 3 comprises a north portion 31, a south portion 32, and at least one rivet 33. The at least one magnet 3 is a diametrically magnetized neodymium magnet where the magnetic points of attractions, the north portion 31 and the south portion 32, are positioned adjacent to each other along the length of the at least one magnet 3. The at least one magnet 3 of the present invention is rotatably sleeved by the inner annular wall 14 so that the north portion 31 and the south portion 32 of at least one magnet 3 is able to swivel inside the inner annular wall 14. The present invention preferably uses a cylindrical magnet or a spherical magnet as the at least one magnet 3; however, the at least one magnet 3 of the present invention may be any other geometric shaped magnet as long as the magnet is able to optimized its functionality within the present invention. The at least one rivet 33 is traversed through the outer annular wall 13 and the inner annular wall 14, where the at least one rivet 33 restricts the radial movement of the at least one magnet 3 within the inner annular wall 14. The at least one rivet 33 can be made of non-magnetic and lightweight materials such as plastic or can be covered with non-magnetic materials so that the at least one magnet 3 does not attach with the at least one rivet 33.

The first configuration of the at least one magnet 3 is shown in FIG. 4, where the at least one magnet 3 is adjacently positioned with the coupling 4 in such way that the at least one magnet 3 can be either adjacently positioned with the first base portion 42 or the second base portion 43. The at least one rivet 33 of the at least one magnet 3 comprises a first rivet 331 and a second rivet 332, where the first rivet 331 and the second rivet 332 function as the barrier for the at least one magnet 3. More specifically, the first rivet 331 is positioned in between the at least one magnet 3 and the coupling 4, and the second rivet 332 is positioned adjacent to the at least one magnet 3 opposite from the first rivet 331 so the first rivet 331 and the second rivet 332 are able to restrict the radial movement of the at least one magnet 3 within the first configuration.

Figure 9:
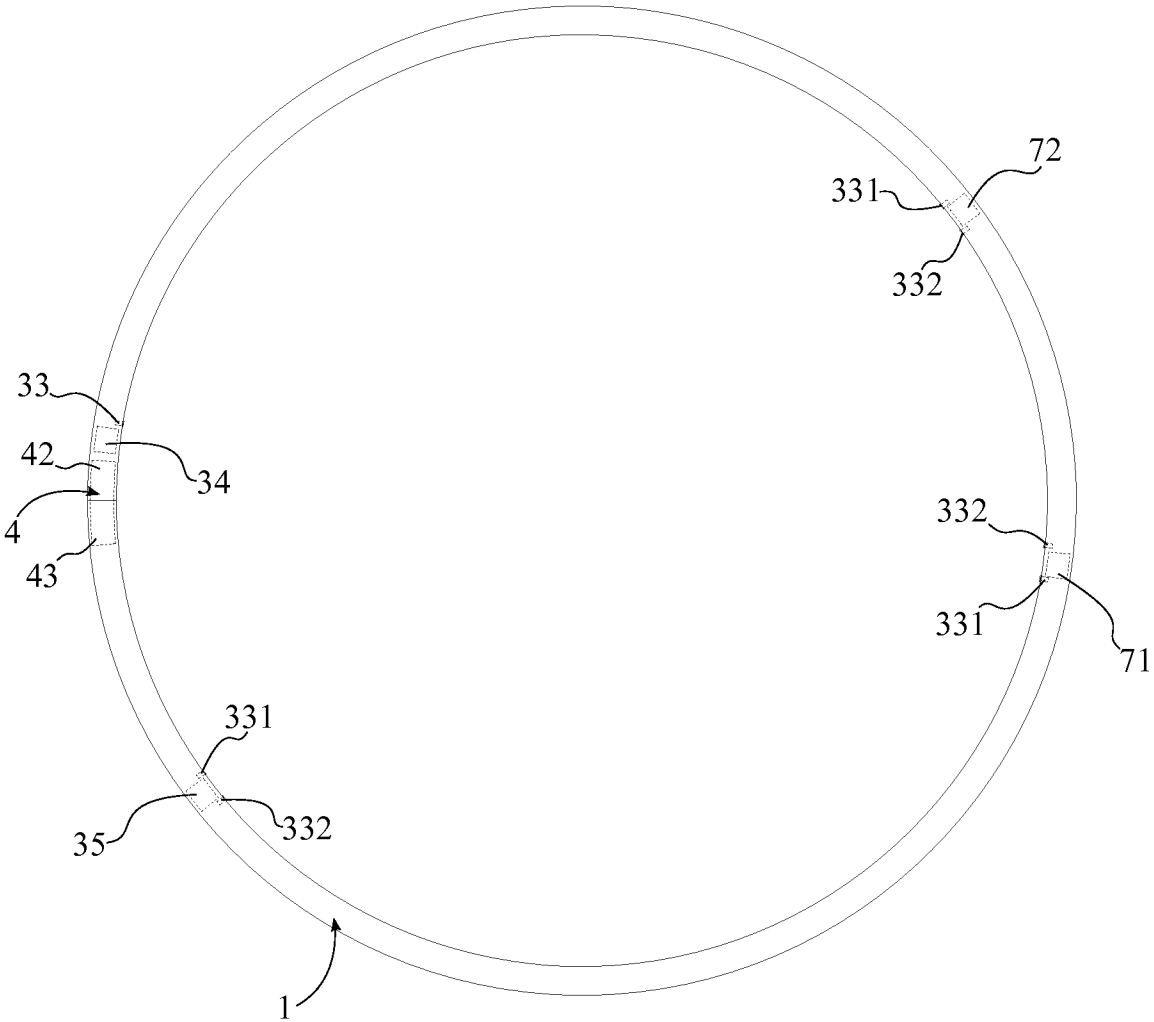
FIG. 9 is a top view of the first alternative embodiment of the present invention without the ornamental tape and the protective tape, wherein the hidden components are illustrated with the dash lines.

The second configuration of the at least one magnet 3 is shown in FIG. 9, where the at least one magnet 3 is adjacently positioned with the coupling 4 in such way that the at least one magnet 3 can be either adjacently positioned with the first base portion 42 or the second base portion 43. The at least one rivet 33 of the at least one magnet 3, which functions as the barrier for the at least one magnet 3, is adjacently positioned with the at least one magnet 3 opposite from the coupling 4, where the at least one rivet 33 restricts the radial movement of the at least one magnet 3 within the second configuration.

The third configuration of the at least one magnet 3 is shown in FIG. 9, where the at least one magnet 3 positions in between the first end 11 and the second end 12 as the at least one magnet 3 is rotatably sleeved by the inner annular wall 14. The at least one rivet 33 of the at least one magnet 3 comprises the first rivet 331 and the second rivet 332, where the first rivet 331 and the second rivet 332 function as the barrier for the at least one magnet 3. More specifically, the first rivet 331 is positioned adjacent to the at least one magnet 3, and the second rivet 332 is positioned adjacent to the at least one magnet 3 opposite from the first rivet 331 so that the first rivet 331 and the second rivet 332 restrict the radial movement of the at least one magnet 3 within the third configuration.

Figure 5:
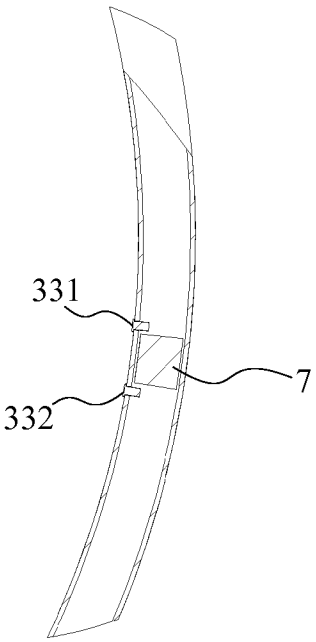
FIG. 5 is a detail section view illustrating the inside components of the present invention, showing the detail section-B of FIG. 3.

In reference to FIG. 3 and FIG. 5, the at least one counterweight 7 of the present invention comprises at least one rivet 33. The at least one counterweight 7 of the present invention is permanently sleeved by the inner annular wall 14 so that the at least one counterweight 7 is not able to swivel inside the inner annular wall 14. The at least one counterweight 7 is often shimmed or covered with tape to prevent unnecessary rattle or loose sounds. The at least one counterweight 7 of the present invention can be a non-magnetic weight or a magnetic weight, but the weight of the at least one counterweight 7 has to be equal to the weight of the at least one magnet 3. If the at least one counterweight 7 of the present invention is a magnetic weight, the magnetic weight functions similar to the at least one magnet 3. The at least one rivet 33 is traversed through the outer annular wall 13 and the inner annular wall 14, where the at least one rivet 33 restricts the radial movement of the at least one counterweight 7 within the inner annular wall 14. The at least one rivet 33 can be made of non-magnetic and lightweight materials such as plastic or can be covered with non-magnetic materials so that at least one magnetic counterweight 7 does not attach with the at least one rivet 33. The at least one counterweight 7 of the present invention provides an equilibrium force with relative to the weight of the at least one magnet 3 so that the present invention can be balanced. Since the at least one counterweight 7 balances the present invention, the present invention can be easily tossed, swung, or juggled by the users.

Figure 12:
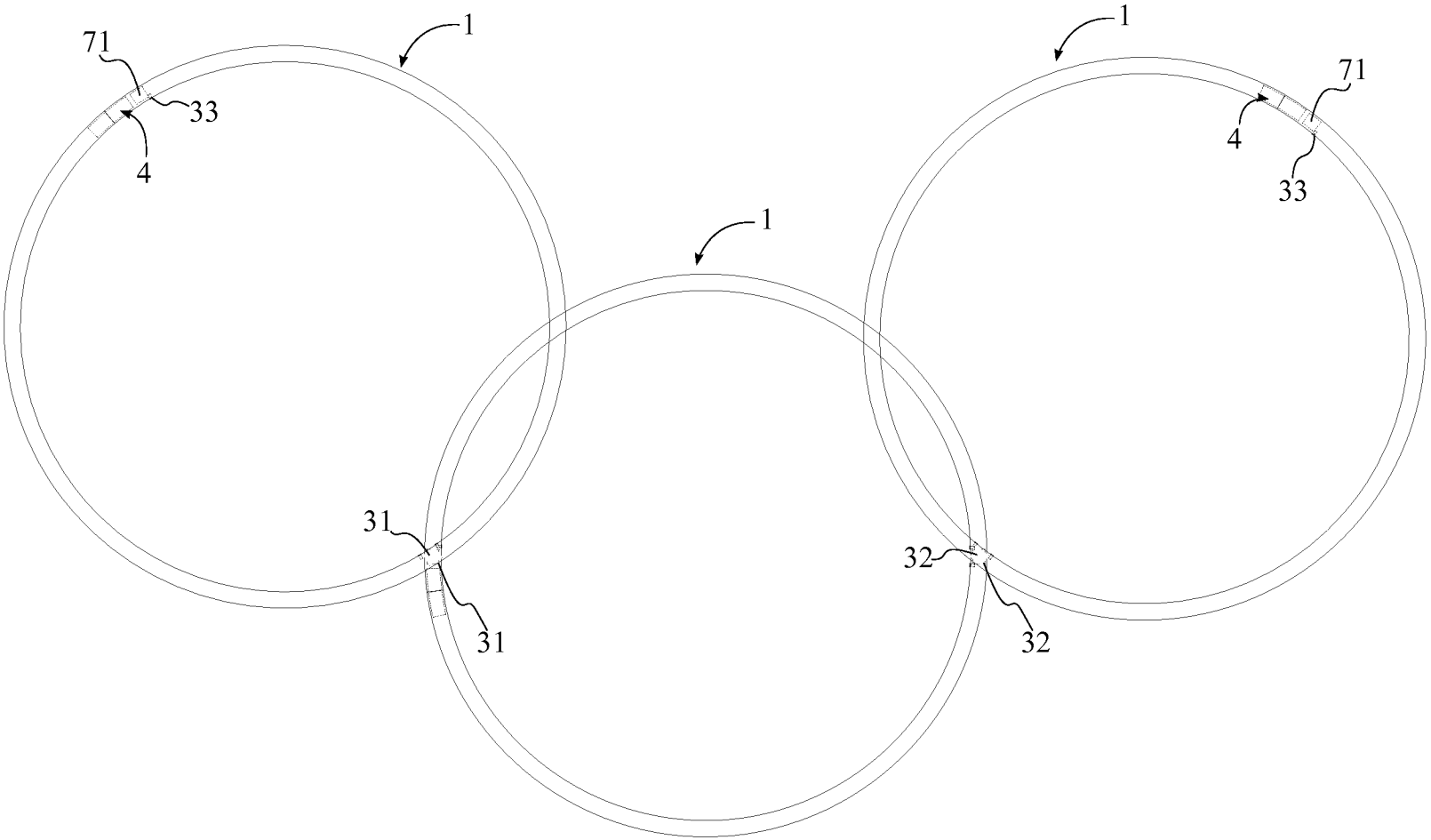
FIG. 12 is a top view illustrating a system of the present invention wherein each of the embodiments is magnetically attached to each other.

The first configuration of the at least one counterweight 7 is shown in FIG. 12, where the at least one counterweight 7 is adjacently positioned with the coupling 4 in such way that the at least one magnet 3 can be either adjacently positioned with the first base portion 42 or the second base portion 43. The at least one rivet 33 of the at least one counterweight 7, which functions as the barrier for the at least one counterweight 7, is adjacently positioned with the at least one counterweight 7 opposite from the coupling 4, where the at least one rivet 33 restricts the radial movement of the at least one counterweight 7 within the first configuration.

The second configuration of the at least one counterweight 7 is shown in FIG. 5, where the at least one counterweight 7 positions in between the first end 11 and the second end 12 as the at least one counterweight 7 is permanently sleeved by the inner annular wall 14. The at least one rivet 33 of the at least one counterweight 7 comprises the first rivet 331 and the second rivet 332, where the first rivet 331 and the second rivet 332 function as the barrier for the at least one counterweight 7. More specifically, the first rivet 331 is positioned adjacent to the at least one counterweight 7, and the second rivet 332 is positioned adjacent to the at least one counterweight 7 opposite from the first rivet 331 so that the first rivet 331 and the second rivet 332 restrict the radial movement of the at least one counterweight 7 within the second configuration.

The at least one magnet 3 and the at least one counterweight 7 of the present invention are considered as hoop weights where the present invention requires minimum of two hoop weights. The at least one counterweight 7 of the present invention may comprise magnetic weights similar to the at least one magnet 3, non-magnetic weights, or any combination of the magnetic weights and the non-magnetic weights, if the present invention comprises more than two hoop weights. When the present invention comprises an even-number of hoop weights, the at least one magnet 3 and the at least one counterweight 7 are diametrically opposed to each other around the circular shaped hoop. When the present invention comprises an odd-number of hoop weights, the odd-number of hoop weights are equally spaced around the circular shaped hoop with similar arc lengths 10 in between each of the hoop weights.

Figure 6:
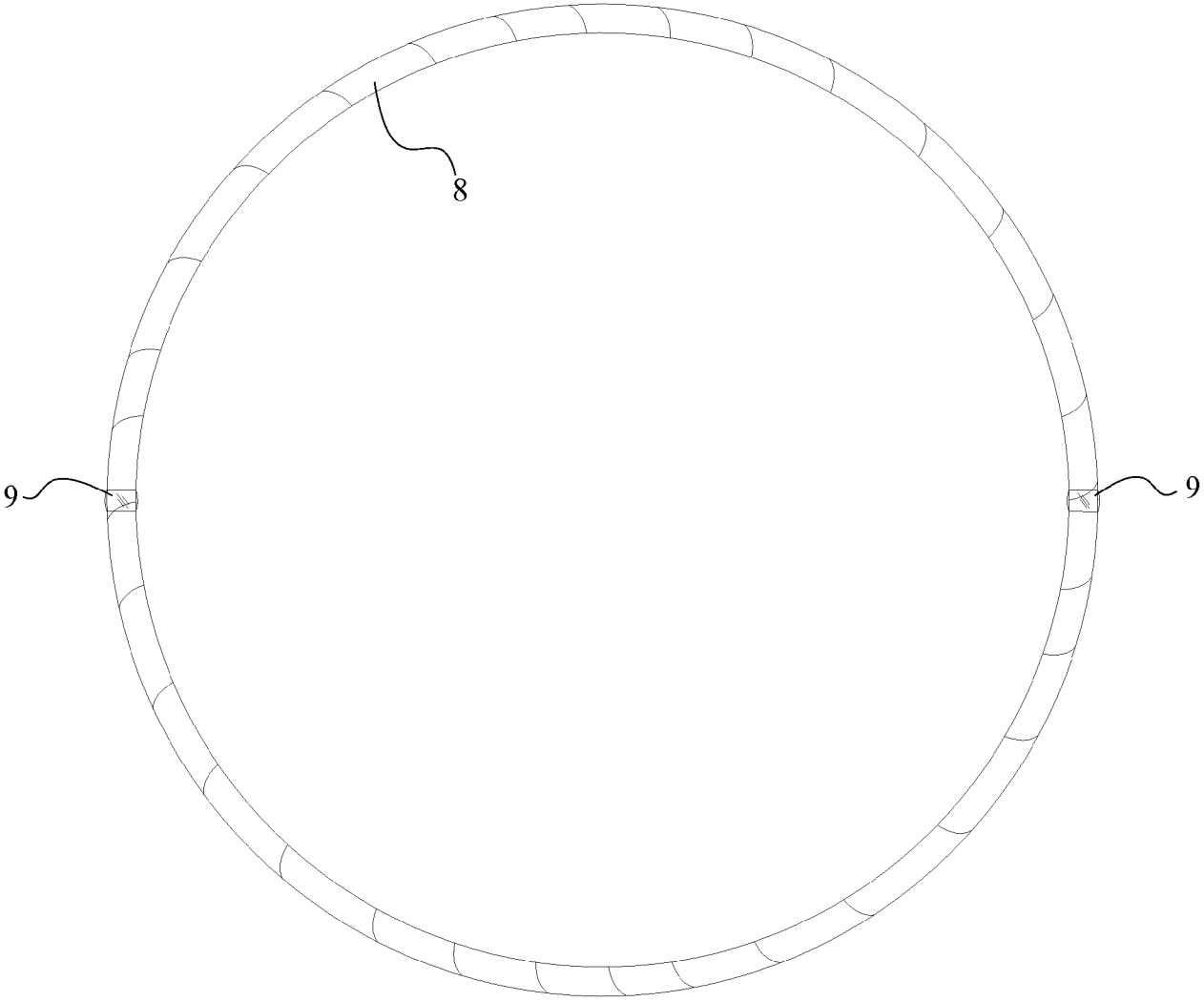
FIG. 6 is a top view of the present invention with the ornamental tape and the protective tape.
Figure 7:
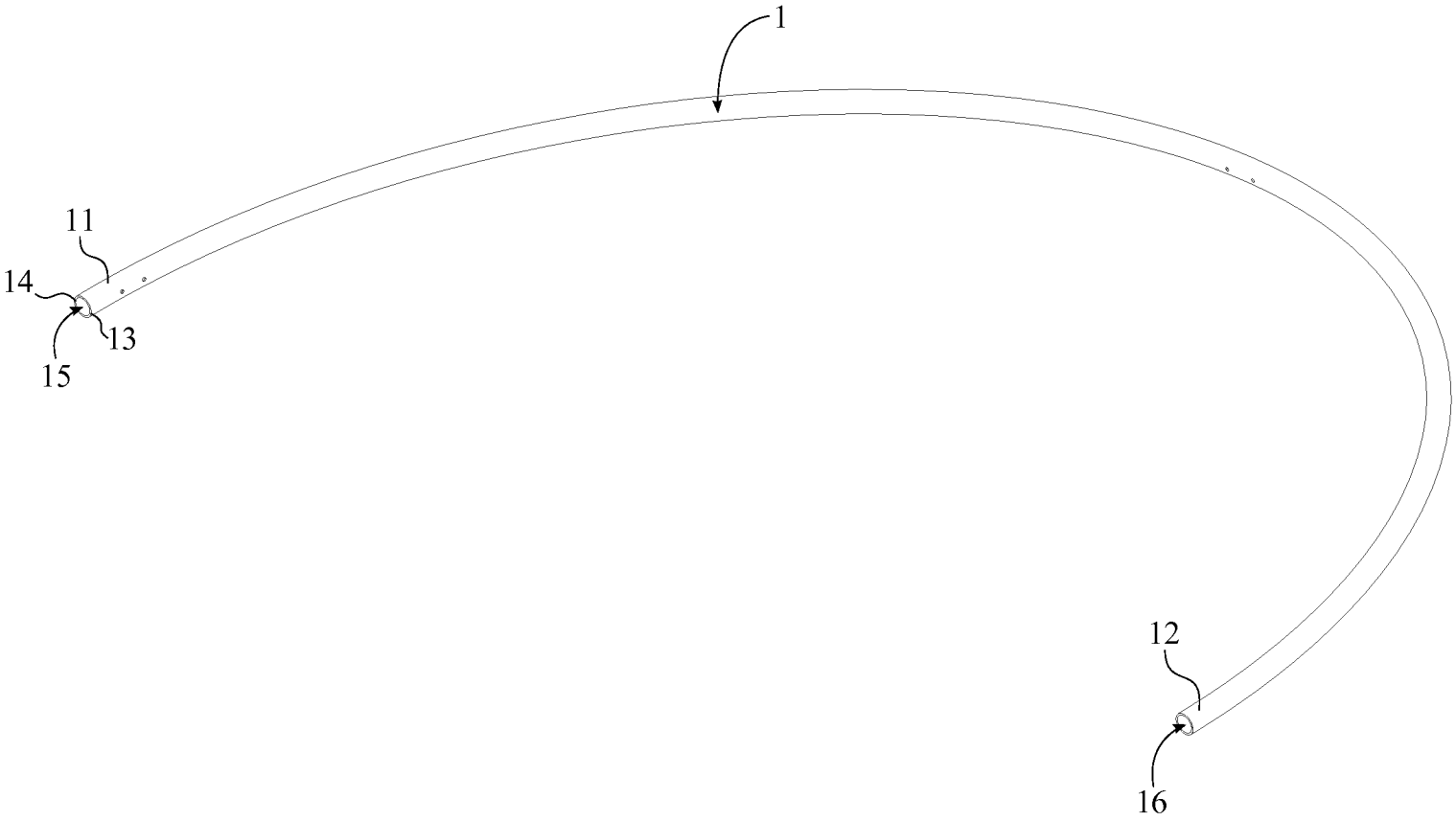
FIG. 7 is perspective view of the hollow tube of the present invention.

In reference to FIG. 6, the ornamental tape 8 is wrapped around the hollow tube 1 so that the at least one magnet 3, the at least one rivet 33, and the at least one counterweight 7 can be hidden within the ornamental tape 8. The ornamental tape 8 can include, but is not limited to, tapes of holographic, glow, or other types of tapes. When the present invention is wrapped with the ornamental tape 8, the ornamental tape 8 hides the magnetic points of attractions to create stronger "magical-like" illusions. Even though the ornamental tape 8 is used to cover the at least one magnet 3, the at least one rivet 33, and the at least one counterweight 7, the present invention can also use solid color opaque tubing as an alternative method to cover the at least one magnet 3, the at least one rivet 33, and the at least one counterweight 7. The protective tape 9 is wrapped over the ornamental tape 8 adjacent to the at least one magnets 3 so that the ornamental tape 8 can be protected against the wearing down due to friction. A transparent tape is used as the protective tape 9 in the present invention to ensure the complete visibility of the ornamental tape 8. Additionally, the ornamental tape 8 comprises an indication mark, where the indication mark is positioned on the ornamental tape 8 adjacent the at least one magnet 3 so that the users can easily identify the at least one magnet 3 apart from the non-magnetic counterweight 7.

Figure 10:
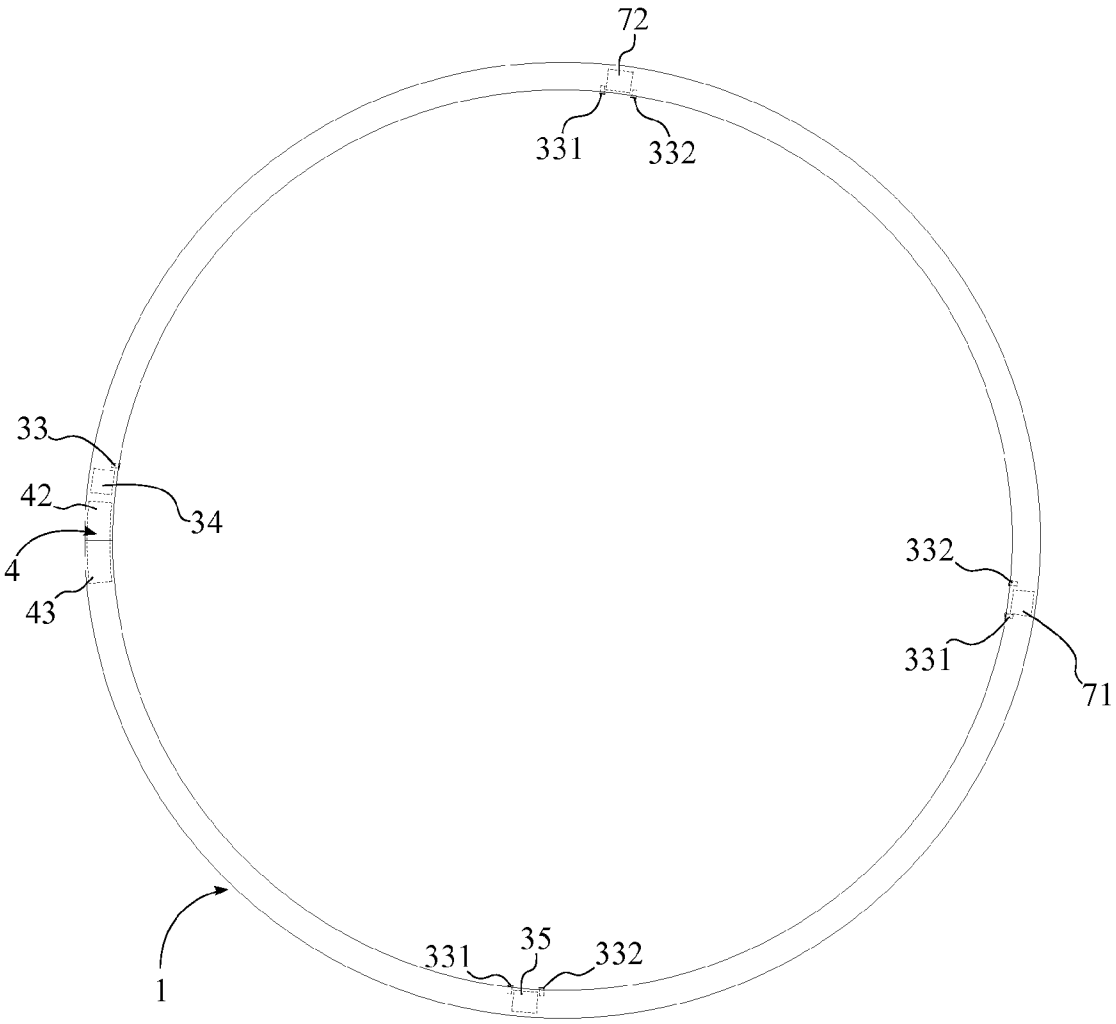
FIG. 10 is another top view of the first alternative embodiment of the present invention without the ornamental tape and the protective tape, wherein the hidden components are illustrated with the dash lines.

In reference to FIG. 9 and FIG. 10, the first alternative embodiment of the present invention comprises similar components as the present invention and is completed with the even number of hoop weights. As for the even number of hoop weights, the at least one magnet 3 further comprises into a first magnet 34 and a second magnet 35, and the at least one counterweight 7 further comprises into a first counterweight 71 and a second counterweight 72. The first counterweight 71 is diametrically opposed from the first magnet 34, and the second counterweight 72 is diametrically opposed from the second magnet 35 to ensure the force equilibrium within the first alternative embodiment. If the first magnet 34 is adjacently positioned with the coupling 4, the at least one rivet 33 of the first magnet 34 and the coupling 4 restrict the radial movement of the first magnet 34 as the radial movement of the first counterweight 71 is restricted by the first rivet 331 and the second rivet 332 of the first counterweight 71. If the second magnet 35 is positioned away from the coupling 4, the at least one rivet 33 of the second magnet 35 comprises the first rivet 331 and the second rivet 332, where the first rivet 331 and the second rivet 332 are adjacently positioned with the second magnet 35 to restrict the radial movement of the second magnet 35. Similarly, the at least one rivet 33 of the second counterweight 72 comprises the first rivet 331 and the second rivet 332, where the first rivet 331 and the second rivet 332 are adjacently positioned with the second counterweight 72 to restrict the radial movement of the second counterweight 72. If the first magnet 34, the second magnet 35, the first counterweight 71, and the second counterweight 72 are positioned away from the coupling 4, the adjacently positioned first rivets 331 and the second rivets 332 of the first magnet 34, the second magnet 35, the first counterweight 71, and the second counterweight 72 restrict the radial movement of the first magnet 34, the second magnet 35, the first counterweight 71, and the second counterweight 72.

Figure 11:
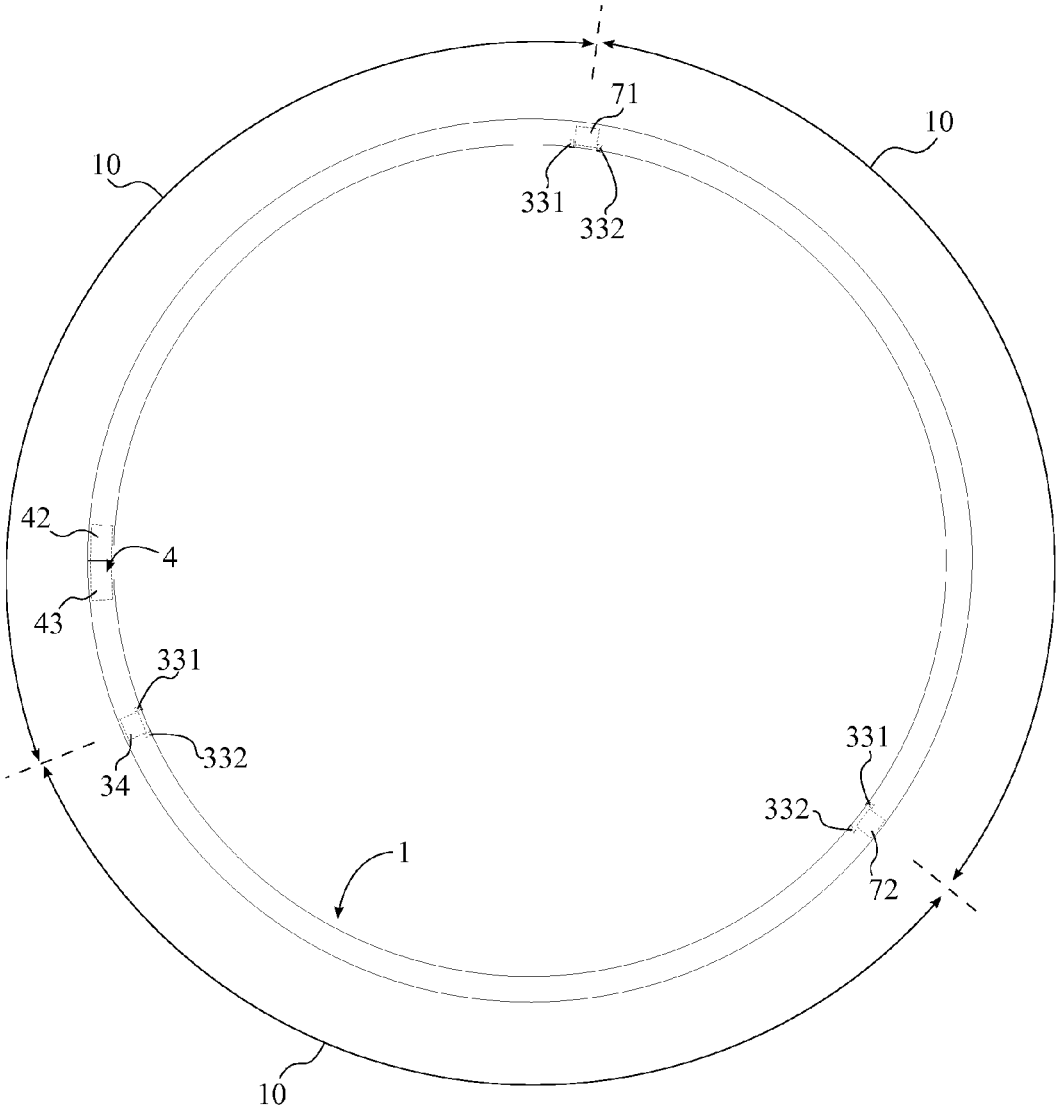
FIG. 11 is a top view of the second alternative embodiment of the present invention without the ornamental tape and the protective tape, wherein the hidden components are illustrated with the dash lines.

In reference to FIG. 11, the second alternative embodiment of the present invention comprises similar components as the present invention where the second alternative embodiment has the odd-number of hoop weights. As for the odd-number of hoop weights, he at least one magnet 3 of the second alternative embodiment comprise the first magnet 34, and the at least one counterweight 7 comprises the first counterweight 71 and the second counterweight 72, where the first counterweight 71 and the second counterweight 72 can be magnetic weights or non-magnetic weights. The first magnet 34, the first counterweight 71, and the second counterweight 72 are equally spaced around the circular shaped hoop with similar arc lengths 10 in between them so that the second alternative embodiment can be balanced to ensure the force equilibrium. The at least one rivet 33 of the second alternative embodiment comprises the first rivets 331 and the second rivets 332, where the first rivets 331 and the second rivets 332 are adjacently positioned with the first magnet 34, the first counterweight 71, and the second counterweight 72 to restrict the radial movement of the first magnet 34, the first counterweight 71, and the second counterweight 72 within the inner annular wall 14.

The present invention can be of any diameter and may contain any number, shape, and strength of at least one magnet 3 or at least one counterweight 7. The endless variety of sizing options, number of magnets and combinations of hoops provide limitless opportunities for artistic expression, hoop dance, experimentation, and performance with multiple hoop play.

When at least two hoops are used together, the magnetic points of attraction are on the sides of the at least one magnet 3 which allows the at least one magnet 3 to turn inside the inner annular wall 14. Since the north portion 31 and the south portion 32 can swivel within the annular wall 14, the magnetic points of attraction can vary and be adjusted by the user. Then the at least two hoops can easily connect side to side, at outer edges, or any combinations thereof. For example, in reference to FIG. 12, a first hoop and a second hoop that comprise the at least one magnet 3 and the at least one non-magnetic counterweight 7 are magnetically attached to a third hoop that comprises the at least one magnet 3 and the at least one magnetic counterweight 7, where the first hoop and the second hoop can be manipulated, moved, or swung by the force applied to the first hoop and the second hoop. The third hoop is positioned in between the first hoop and the second hoop, where the first hoop is positioned to the left and the second hoop is positioned to the right. More specifically, the north portion 31 of the at least one magnet 3 in the third hoop is magnetically attached with the south portion 32 of the at least one magnet 3 in the first hoop, where the south portion 32 is positioned underneath the north portion 31. The south portion 32 of the one magnetic counterweight 7 in the third hoop is magnetically attached with the north portion 31 of the at least one magnet 3 in the second hoop, where the north portion 31 is positioned underneath the south portion 32.

Even though the present invention is illustrated within the circular shaped hoop, the present invention can also shaped into a square shaped apparatus, a triangular shaped apparatus, or any other geometric shaped apparatus while utilizing the exact positioning for the at least one magnet 3 and the at least one counterweight 7.

Although the invention has been explained in relation to its preferred embodiment, it is to be understood that many other possible modifications and variations can be made without departing from the spirit and scope of the invention as hereinafter claimed.

What is claimed is:

1. A magnetic hoop apparatus comprises:

a hollow tube;

at least one magnet;

a coupling;

at least one counterweight;

an ornamental tape;

a protective tape;

the hollow tube comprises a first end, a second end, an outer annular wall, an inner annular wall, a first opening, and a second opening;

the at least one magnet comprises a north portion and a south portion;

the coupling comprises a first base portion and a second base portion;

the at least one magnet and the at least one counterweight each comprise an at least one rivet; and the first end of the hollow tube being positioned adjacent with the second end of the hollow tube in order to form a circular shape.

2. The magnetic hoop apparatus as claimed in claim 1 comprises:

the inner annular wall being concentrically positioned within the outer annular wall;

the first end and the second end for the hollow tube being positioned opposite to each other along the hollow tube;

the first opening traversing into the first end and being encircled by the inner annular wall; and the second opening traversing into the second end and being encircled by the inner annular wall.

3. The magnetic hoop apparatus as claimed in claim 1 comprises:

the first base portion and the second base portion being oppositely positioned from each other along the coupling.

4. The magnetic hoop apparatus as claimed in claim 1 comprises:

the first base portion being inserted into the first opening;

the first base portion being permanently connected with the first end;

the first base portion being concentrically positioned within the inner annular wall;

the second base portion being inserted into the second opening; and the second base portion being concentrically positioned within the inner annular wall.

5. The magnetic hoop apparatus as claimed in claim 4 comprises:

the second base portion being removably attached within the second end by an attachment mechanism.

6. The magnetic hoop apparatus as claimed in claim 4 comprises:

the second base portion being permanently connected with the second end.

7. The magnetic hoop apparatus as claimed in claim 1 comprises:

the at least one magnet being rotatably sleeved by the inner annular wall;

the north portion and the south portion being positioned adjacent to each other within the inner annular wall; and the at least one rivet being traversed through the outer annular wall and the inner annular wall, wherein the at least one rivet restricts the radial movement of the at least one magnet within the inner annular wall.

8. The magnetic hoop apparatus as claimed in claim 1 comprises:

the at least one magnet being adjacently positioned with the coupling;

the at least one rivet comprises a first rivet and a second rivet;

the first rivet being positioned in between the at least one magnet and the coupling; and the second rivet being positioned adjacent to the at least one magnet opposite from the first rivet.

9. The magnetic hoop apparatus as claimed in claim 1 comprises:

the at least one magnet being adjacently positioned with the coupling; and the at least one rivet being adjacently positioned the at least one magnet opposite from the coupling.

10. The magnetic hoop apparatus as claimed in claim 1 comprises:

the at least one magnet being positioned along the hollow tube in between the first end and the second end;

the at least one rivet comprises a first rivet and a second rivet;

the first rivet being positioned adjacent to the at least one magnet; and the second rivet being positioned adjacent to the at least one magnet opposite from the first rivet.

11. The magnetic hoop apparatus as claimed in claim 1 comprises:

the at least one counterweight being permanently sleeved by the inner annular wall; and the at least one rivet being traversed through the outer annular wall and the inner annular wall, wherein the at least one rivet restricts the radial movement of the at least one counterweight within the inner annular wall.

12. The magnetic hoop apparatus as claimed in claim 1 comprises:

the at least one counterweight being positioned in between the first end and the second end;

the at least one rivet comprises a first rivet and a second rivet;

the first rivet being positioned adjacent to the at least one counterweight; and the second rivet being positioned adjacent to the at least one counterweight opposite from the first rivet.

13. The magnetic hoop apparatus as claimed in claim 1 comprises:

the at least one counterweight being adjacently positioned with the coupling; and the at least one rivet being positioned adjacent to the at least one counterweight opposite from the coupling.

14. The magnetic hoop apparatus as claimed in claim 8 comprises:

the at least one counterweight being a non-magnetic weight.

15. The magnetic hoop apparatus as claimed in claim 8 comprises:

the at least one counterweight being a magnetic weight, wherein the magnetic weight being similar to the at least one magnet.

16. The magnetic hoop apparatus as claimed in claim 1 comprises:

the at least one magnet and the at least one counterweight form an even-number of hoop weights; and the at least one counterweight and the at least one magnet being diametrically opposed to each other around the circular shape.

17. The magnetic hoop apparatus as claimed in claim 1 comprises:

the at least one magnet and the at least one counterweight form an odd-number of hoop weights; and the odd-number of hoop weights being equally spaced around the circular shape with similar arc lengths.

18. The magnetic hoop apparatus as claimed in claim 1 comprises:

the ornamental tape being wrapped around the hollow tube; and the protective tape being wrapped around the ornamental tape adjacent to the at least one magnet.

* * * * *